US007220292B2

(12) United States Patent
Morimoto et al.

(10) Patent No.: US 7,220,292 B2
(45) Date of Patent: May 22, 2007

(54) METALLIC FIBER NONWOVEN FABRIC MANUFACTURING APPARATUS, ITS MANUFACTURING METHOD AND LAMINATED ALUMINUM MATERIAL MANUFACTURING METHOD

(75) Inventors: Toru Morimoto, Chiba (JP); Kouichi Onodera, Tokyo (JP); Yoshinori Nakao, Tokyo (JP); Keitaro Nakayama, Tokyo (JP); Masamichi Sekiya, Tokyo (JP)

(73) Assignees: Kabushiki Kaisha Unix, Tokyo (JP); Akaoarumi Kabushiki Kaisha, Tokyo (JP); Toru Morimoto, Chiba (JP)

( * ) Notice: Subject to any disclaimer, the term of this patent is extended or adjusted under 35 U.S.C. 154(b) by 563 days.

(21) Appl. No.: 10/483,884

(22) PCT Filed: Jul. 16, 2002

(86) PCT No.: PCT/JP02/07208

§ 371 (c)(1),
(2), (4) Date: Jan. 14, 2004

(87) PCT Pub. No.: WO03/008690

PCT Pub. Date: Jan. 30, 2003

(65) Prior Publication Data

US 2004/0231124 A1 Nov. 25, 2004

(30) Foreign Application Priority Data

Jul. 18, 2001 (JP) ..... 2001-218222
Jul. 23, 2001 (JP) ..... 2001-221230

(51) Int. Cl.
*B22F 9/06* (2006.01)
*C21C 1/06* (2006.01)

(52) U.S. Cl. ..... 75/331; 266/202

(58) Field of Classification Search ..... 266/202; 75/331, 330; 29/419.1
See application file for complete search history.

(56) References Cited

U.S. PATENT DOCUMENTS 3,602,291 A * 8/1971 Pond ..... 164/423
RE28,470 E * 7/1975 Webber ..... 29/419.1
6,298,538 B1 * 10/2001 Krupnik et al. ..... 29/419.1

FOREIGN PATENT DOCUMENTS

EP 0 041 534 8/1984
JP 59-082411 A 5/1984
JP 59-211646 A 11/1984
JP 62- 294104 12/1987

OTHER PUBLICATIONS

International Search Report, no date.
Publication No. JP 7-122106, no date.
Published Application No. 05-156377 with English translation, no date.
Publication No. JP 3-16182 B, no date.

* cited by examiner

*Primary Examiner*—Scott Kastler
(74) *Attorney, Agent, or Firm*—Hovey Williams LLP

(57) ABSTRACT

The present invention provides a metallic fiber nonwoven fabric manufacturing apparatus mainly including a metallic fiber manufacturing apparatus (7), an ejection nozzle heater (5), a metallic fiber flying apparatus (6), a nonwoven fabric surface density control mechanism, a method for manufacturing an aluminum fiber fabric by using the metallic fiber nonwoven fabric manufacturing apparatus, and a method for manufacturing a laminated aluminum material. By using the metallic fiber nonwoven fabric manufacturing apparatus, manufacture of a high-quality metallic fiber nonwoven fabric and manufacture of an aluminum fiber nonwoven fabric are possible. Further, manufacture of a laminated aluminum material is also possible.

24 Claims, 6 Drawing Sheets

METALLIC FIBER NONWOVEN FABRIC MANUFACTURING APPARATUS, ITS MANUFACTURING METHOD AND LAMINATED ALUMINUM MATERIAL MANUFACTURING METHOD

TECHNICAL FIELD

The present invention relates to a metallic fiber nonwoven fabric manufacturing apparatus, a method of manufacturing an aluminum fiber nonwoven fabric and a method of manufacturing a laminated aluminum material.

BACKGROUND ART

The manufacture of metallic fibers including aluminum fibers is already carried out. For example, JP 59-82411 A discloses a method and apparatus for manufacturing fibers of a metal or alloy thereof by keeping the metal or alloy thereof in a molten state in a closed vessel, supplying a pressurized gas into a crucible in the closed vessel to press the molten metal in order to raise a molten metal feed pipe, and ejecting the molten metal from ejection holes of a nozzle into the atmosphere to be quenched and solidified.

Since molten aluminum is ejected and discharged from pores with 0.08 mm Ø into the atmosphere to manufacture aluminum fibers by the method of the above publication, non-metallic inclusions in the molten aluminum are caught in the pores to make a jet from the pores imperfect or cause partial occlusion of some of the plural pores.

When preheating of a fireproof nozzle body constituting the plural pores is incomplete, the molten aluminum extruded from the inside of the above crucible is solidified instantaneously in the plural pores to occlude most of the plural pores, thereby interrupting an operation.

JP 62-294104 A discloses a method of manufacturing a porous metal body by dropping metallic fibers to deposit on one end of a belt conveyor and press molding them at the other end of the belt conveyor.

When molten aluminum is ejected from the ejection holes of the nozzle into the atmosphere, aluminum fibers manufactured by quenching and solidifying float in the air. Therefore, even when they drop on the above belt conveyor, they hardly drop at a uniform density and the areal (surface) density ($g/m^2$) of the porous metal body of the aluminum fibers press-molded at the other end of the belt conveyor tends to become extremely nonuniform. Accordingly, when it is used as a sound absorbent material or electromagnetic shielding material, its characteristics become unstable and a quality problem easily occurs.

When an aluminum fiber porous body (to be referred to as aluminum fiber nonwoven fabric hereinafter) is to be manufactured using the prior art as described above, if non-metallic inclusions in molten aluminum are caught in the pores (to be referred to as ejection holes hereinafter) of a nozzle body made of a refractory (to be referred to as ejection nozzle hereinafter) and adhered to the ejection holes, an imperfect ejection state is created and a jet of the molten aluminum is greatly disturbed, thereby causing the deterioration of a quality of an aluminum fiber nonwoven fabric. When the preheating of the ejection nozzle is insufficient, molten aluminum which reaches the inside of the ejection nozzle is instantaneously solidified at the beginning of ejection, whereby most of the ejection holes are occluded and the operation is suspended.

Further, when aluminum fibers ejected from the ejection nozzles fly nonuniformly in the air, the amount of the fibers dropped on the belt conveyor becomes nonuniform, with the result that the areal density of the nonwoven fabric becomes nonuniform and there are variations in the quality and characteristics such as sound absorption coefficients of the nonwoven fabric.

It is an object of the present invention to provide an apparatus for manufacturing a metallic fiber nonwoven fabric having stable quality and characteristics which solve the above problems of the prior art, a method of manufacturing an aluminum fiber nonwoven fabric having stable quality and characteristics using the apparatus, and a method of manufacturing a laminated aluminum material.

The inventors of the present invention have come across the above problems in the research and development process of an aluminum fiber nonwoven fabric, have conducted intensive experimental studies and have found that the object of the present invention can be attained by the apparatus and methods of the present invention. The present invention has thus been accomplished based on the finding. Note that reference numerals in the following description are given for the reference of the accompanying drawings. The present invention is not limited to examples shown in these drawings.

DISCLOSURE OF THE INVENTION

A first aspect of the present invention is a metallic fiber nonwoven fabric manufacturing apparatus characterized by including:

a melting furnace 1 including a molten metal purifying unit 2;

a metallic fiber manufacturing unit 7 which includes a closed vessel 4 having a crucible 20 for storing a molten metal and a heater 21 therefor; a molten metal feed pipe 22 having one opening near a bottom portion of the crucible 20, the other opening outside the closed vessel 4 and an ejection nozzle 27 having a plurality of ejection holes for ejecting the molten metal 29 to the outside of the closed vessel 4 at an end of the other opening; and a pressure unit 25 for supplying a pressurized gas into the closed vessel 4;

an ejection nozzle heater 5 provided on an outer wall of the closed vessel to surround the ejection nozzle 27;

a metallic fiber flying control unit 6 for discharging compressed air as a control fluid for promoting a uniform distribution of metallic fibers 10 by controlling flying of the metallic fibers 10 produced by solidifying the molten metal ejected from the ejection nozzle 27;

an accumulating/conveying unit 11 for temporarily accumulating the produced metallic fibers 10 and conveying the fibers;

a roll-press unit 12 for press-molding a metallic fiber nonwoven fabric 18 by roll-pressing the obtained accumulated product of the metallic fiber;

a nonwoven fabric areal density control mechanism for controlling a surface density of the metallic fiber nonwoven fabric 18 to a predetermined range; and an automatic nonwoven fabric cutter 14.

A second aspect of the present invention is the metallic fiber nonwoven fabric manufacturing apparatus according to the first aspect of the invention which is characterized in that the ejection holes formed in the ejection nozzle 27 of the metallic fiber manufacturing unit 7 according the first aspect of the invention have an inner diameter of 0.05 mm to 0.25 mm, an interval between the adjacent ejection holes is 5 mm or more, and the number of ejection holes satisfies the following expression (1):

$$0.4<nD^2<2.5 \quad (1)$$

wherein n is the number of holes of the ejection nozzle and D is the inner diameter of the ejection holes (mm).

The upper limit of $nD^2$ is preferably 2.0 or less, more preferably less than 2.

A third aspect of the present invention is the metallic fiber nonwoven fabric manufacturing apparatus according to the first or second aspect of the invention which is characterized in that at least one end of the molten metal feed pipe 22 according to the first aspect of the invention is provided with a filter 23 for removing non-metallic inclusions suspended in the molten metal.

A fourth aspect of the present invention is the metallic fiber nonwoven-fabric manufacturing apparatus according to any one of the first to third aspects of the invention which is characterized in that the ejection nozzle heater 5 according to the first aspect of the invention has a length from a surface of the ejection nozzle 27 of 100 to 200 mm in an ejection direction and an inner diameter 2.5 to 4 times an outer diameter of the ejection nozzle 27.

A fifth aspect of the present invention is the metallic fiber nonwoven fabric manufacturing apparatus according to any one of the first to fourth aspects of the invention which is characterized in that the metallic fiber flying control unit 6 according to the first aspect of the invention has compressed air ejection nozzles which are flat nozzles 50 for delivering the compressed air in a flat form.

A sixth aspect of the present invention is the metallic fiber nonwoven fabric manufacturing apparatus according to any one of the first to fifth aspects of the invention which is characterized in that the roll-press unit 12 according to the first aspect of the invention has at least a pair of an upper roll 62 and a lower roll 64 for conveying and pressing the metallic fibers and a surface of the lower roll 64 has a rubber lining 63.

A seventh aspect of the present invention is the metallic fiber nonwoven fabric manufacturing apparatus according to any one of the first to sixth aspects of the invention which is characterized in that the nonwoven fabric areal density control mechanism according to the first aspect of the invention compares a target weight $G_2$ of a desired metallic fiber nonwoven fabric 18 and an actual weight $G_1$ measured by a nonwoven fabric weighing unit 13 with a belt conveyor and controls a moving speed V of the metallic fiber nonwoven fabric 18 at exit of the roll-press unit 12 to minimize a difference therebetween.

An eighth aspect of the present invention is a method of manufacturing an aluminum metallic fiber nonwoven fabric, characterized by including manufacturing an aluminum fiber nonwoven fabric by using the metallic fiber nonwoven fabric manufacturing apparatus according to the first aspect of the invention.

A ninth aspect of the present invention is a method of manufacturing a laminated aluminum material having aluminum fibers sandwiched between aluminum expanded metals 32 and 34, including:

supplying molten aluminum to a metallic fiber manufacturing unit 70 which includes:

a closed vessel having a crucible 20 for storing a molten metal;

a molten metal feed pipe 22 which is open at both ends and has one opening near a bottom portion of the crucible and the other opening situated outside the closed vessel through an opening formed in a side wall of the closed vessel and provided with an ejection nozzle 27 having ejection holes;

a pressure unit 25 for supplying a pressurized gas into the closed vessel; and a metallic fiber flying control unit 6 arranged on a downstream side of the nozzle, for forming an air flow in an ejection direction of the molten metal from the nozzle and continuously changing a direction of the air flow;

accumulating the molten aluminum ejected from the ejection ports uniformly on the aluminum expanded metal 32 as the aluminum fiber with the metallic fiber flying control unit 6 for continuously changing the direction of the air flow from the ejection nozzle;

supplying the expanded metal 34 on the aluminum fibers; and contact bonding the aluminum fibers to the expanded metals from above and below.

The metallic fiber nonwoven fabric manufacturing apparatus 70 that is used for the method according to the ninth aspect of the invention may be a metallic fiber manufacturing apparatus including:

a melting furnace 1 including a molten metal purifying unit 2;

a metallic fiber manufacturing unit 7 which includes a closed vessel 4 having a crucible 20 for storing a molten metal and a heater 21 therefor; a molten metal feed pipe 22 having one-opening near a bottom portion of the crucible 20, the other opening outside the closed vessel 4 and an ejection nozzle 27 having a plurality of ejection holes for ejecting the molten metal 29 to the outside of the closed vessel 4 at an end of the other opening; and a pressure unit 25 for supplying a pressurized gas into the closed vessel 4;

an ejection nozzle heater 5 provided on an outer wall of the closed vessel to surround the ejection nozzle 27;

a metallic fiber flying control unit 6 for discharging compressed air as a control fluid for promoting a uniform distribution of metallic fibers 10 by controlling flying of the metallic fibers 10 produced by solidifying the molten metal ejected from the ejection nozzle 27. In this case, the apparatus according to any one of the second to seventh aspects of the present invention may be used.

BEST MODE FOR CARRYING OUT THE INVENTION

Preferred embodiments of the present invention will be described in detail with reference to the accompanying drawings.

Figure 1:
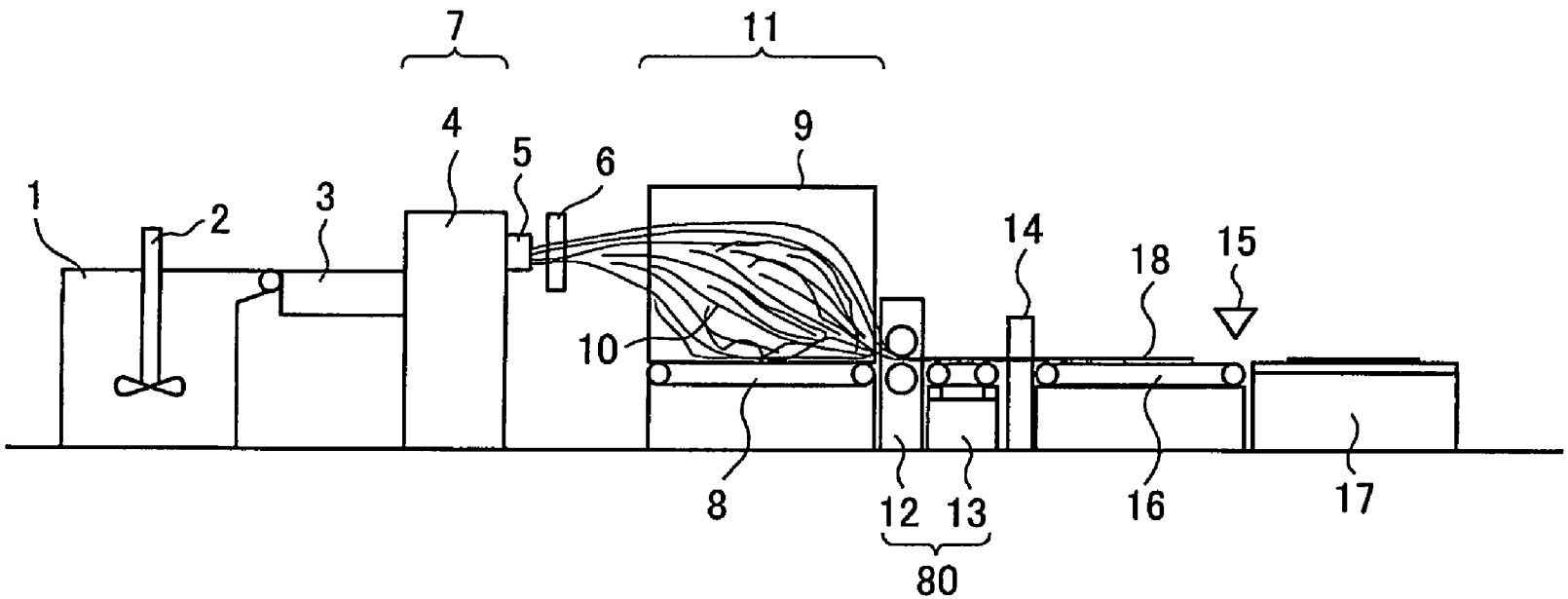
FIG. 1 is a schematic diagram showing an arrangement of a metallic fiber nonwoven fabric manufacturing apparatus of the present invention.

FIG. 1 shows the whole constitution of a preferred example of a metallic fiber nonwoven fabric manufacturing apparatus according to a first aspect of the present invention. The first aspect of the present invention is not limited to this example.

This apparatus is basically composed of a melting furnace 1, a metallic fiber manufacturing unit 7, an ejection nozzle heater 5, a metallic fiber flying control unit 6, a metallic fiber accumulating/conveying unit 11, a nonwoven fabric areal density control mechanism 80 composed of a roll-press unit 12 and a nonwoven fabric weighing unit 13, and an automatic nonwoven fabric cutter 14.

As described in a second aspect of the present invention, inner diameters of the ejection holes of the ejection nozzle 27 for forming metallic fibers 10 used in the present invention are as extremely small as 0.05 mm Ø to 0.25 mm Ø. When an inclusion equal to or larger than the inner diameter is existent in the molten metal 29 right before ejection, it occludes some of the ejection holes to deteriorate a quality of a metallic fiber nonwoven fabric 18. That is, in the course of the occlusion of the ejection holes, a jet of the molten metal 29 is disturbed, whereby a deformed fiber is formed by combining the jet with a jet from another ejection hole, or a drip (a metal piece solidified like slaver) is formed on the surface of the ejection nozzle 27 just before the ejection hole is occluded, and mixed in the nonwoven fabric together with an unstable jet, thereby making it difficult to obtain the satisfactory metallic fiber nonwoven fabric 18.

Consequently, the molten metal 29 must be kept as pure as possible right before it is charged into the closed vessel 4 of the metallic fiber manufacturing unit 7. In the present invention, as shown in FIG. 1, in addition to the melting furnace 1 for melting a metal, a molten metal purifying unit 2 for removing non-metallic inclusions in the molten metal 29 after melting is provided. As the molten metal purifying unit 2 may be used a rotary agitation type molten metal purifying unit of a gas blowing system disclosed by JP 2094592 B. A unit of a different system may also be used as long as the unit has the same performance as the above unit. For example, any unit is acceptable if it can blow an inert gas into a molten metal as an agitation gas and can completely remove an impurity such as a metal oxide by rotation and agitation.

Figure 2:
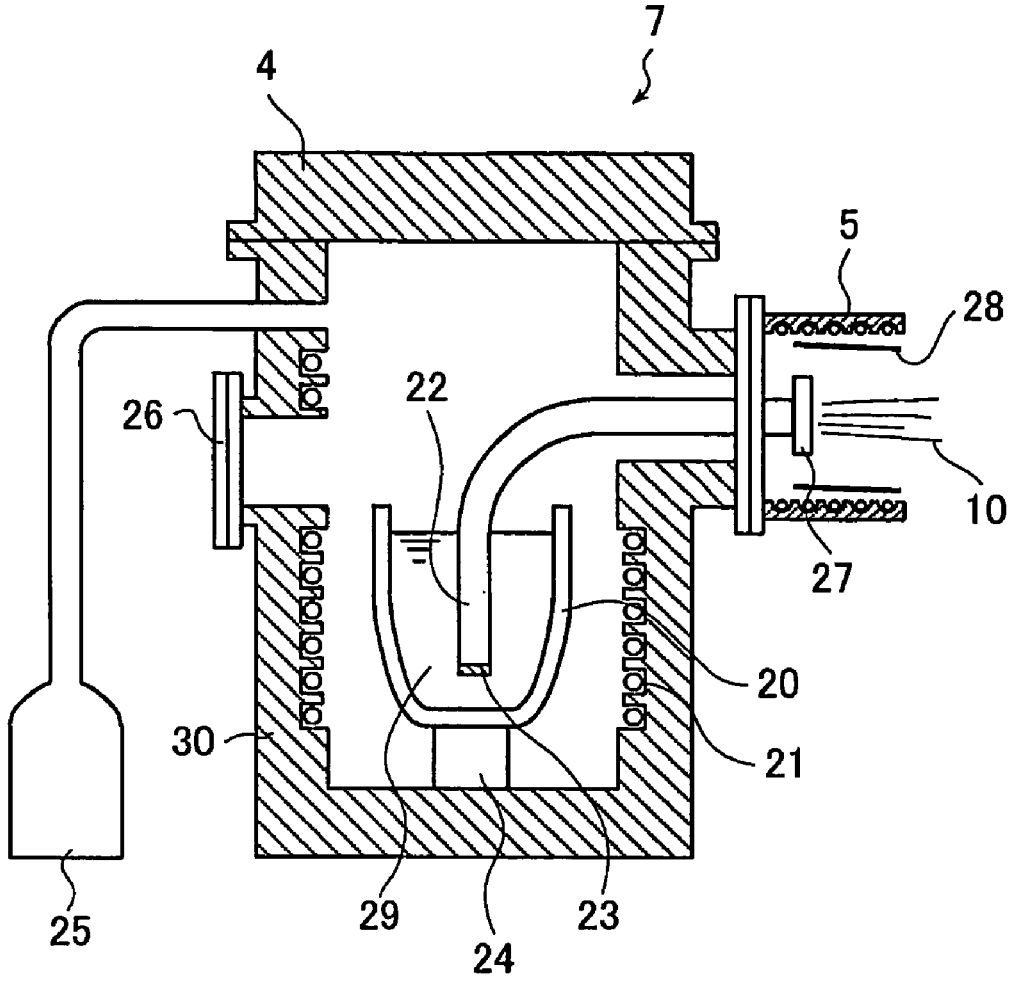
FIG. 2 is a sectional view showing a structure of the metallic fiber manufacturing apparatus.
Figure 7:
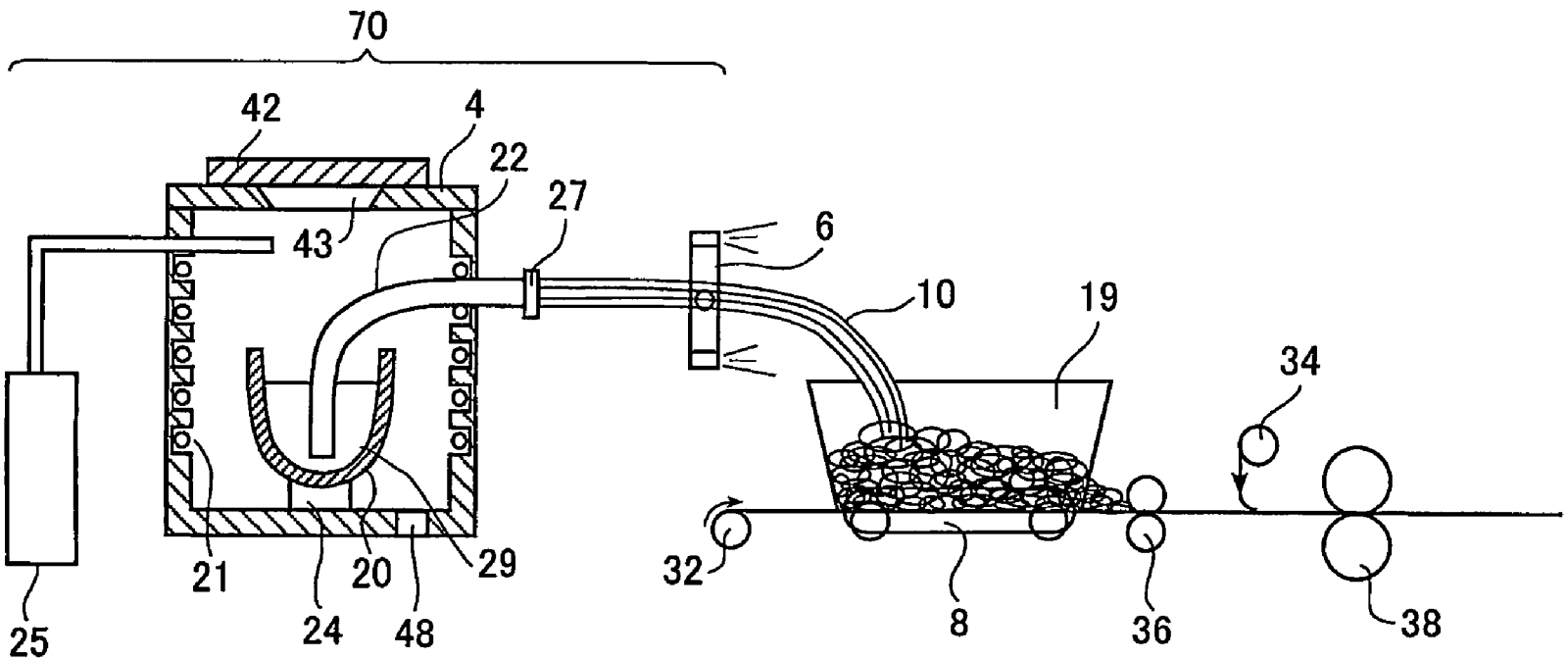
FIG. 7 is a diagram showing a method of manufacturing a laminated aluminum material according to an embodiment of the present invention.

FIG. 1 shows the outline of the metallic fiber manufacturing unit 7 in which the ejection nozzle heater 5 is attached to the closed vessel 4. FIG. 2 is a sectional view of the metallic fiber manufacturing unit 7 according to an embodiment of the present invention in which the ejection nozzle heater 5 is attached to the closed vessel 4, and FIG. 7 is a sectional view of a metallic fiber manufacturing unit 70 according to another embodiment. As described above, the metallic fiber manufacturing unit 7 has a closed structure and is connected to an external pressure unit 25. The pressurized gas is dry air or an inert gas such as a nitrogen gas, an argon gas or a helium gas.

A closed vessel heater 21 is mounted on the inner wall of the closed vessel 4 so that the inside atmospheric temperature can be controlled. A crucible 20 is installed in the closed vessel 4 through a crucible base 24, and the molten metal 29 which has been molten in the above melting furnace 1 and purified with the molten metal purifying unit 2 as pretreatment is supplied into the crucible 20 through a transfer gutter 3. When the crucible 20 is mounted on the crucible base 24, heat is also transferred from the bottom of the crucible 20 to heat the molten metal 29 efficiently. When the crucible 20 is mounted on the crucible base 24, room for arrangement is secured at the bottom of the closed vessel 4 and a drain 48 (FIG. 7) for discharging the molten metal in emergency can be formed. The top portion of the closed vessel 4 can be removed. To exchange or repair the crucible 20, a top lid 42 of the closed vessel 4 can be removed to take out the crucible 20.

The one end of the above molten metal feed pipe 22 is existent in the molten metal 29 near the bottom of the crucible 20, and the other end of the pipe 22 is provided with the ejection nozzle 27 outside the closed vessel 4. The molten metal feed pipe 22 is fixed to the closed vessel 4 by a bolt through a flange.

As described in the second aspect of the present invention, the inner diameter of the ejection holes formed in the ejection nozzle 27 is 0.05 mm to 0.25 mm preferably, the interval between the adjacent ejection holes is 5 mm or more, and the number of ejection holes preferably is the number calculated by the following expression (1):

$$0.4<nD^2<2.5 \quad (1)$$

where n is the number of holes of the ejection nozzle and D is the inner diameter of the ejection holes (mm).

Here, the upper limit of $nD^2$ is preferably 2.0 or less, more preferably less than 2.

The inner diameter of the ejection holes is not particularly limited if it is within the above range but it is preferably 0.07 to 0.15 mm.

According to the results of the past researches, the inner diameter of the ejection holes and the outer diameter of the formed metallic fibers 10 are almost the same and the minimum inner diameter of the ejection holes which can be produced using this apparatus is 0.05 mm. When the inner diameter is smaller than this value, the ejection holes are occluded by fine inclusions suspended in the molten metal 29, thereby making it difficult to produce a satisfactory nonwoven fabric. When the inner diameter is larger than 0.25 mm (the fiber diameter of the nonwoven fabric is larger than 0.25 mm), the diameters of the metallic fibers become too large. Therefore, when an aluminum metallic fiber sound absorbent board is produced, its sound absorption properties become unsatisfactory.

When the interval between adjacent ejection holes is smaller than 5 mm, aluminum fibers which are semi-solidified right after ejection are contacted or fused together to form a deformed fiber easily. Therefore, it is difficult to manufacture a satisfactory aluminum fiber nonwoven fabric.

When the number of holes is below the range calculated by the above expression (1), the flow rate of the molten metal 29 rising in the molten metal feed pipe 22 becomes too low, and the atmospheric temperature of the upper part inside the closed vessel 4 becomes unstable. Thus, the temperature of the rising molten metal becomes unstable as well, thereby readily causing the occlusion of the ejection holes by the molten metal in a semi-solidified state.

When the number of holes is above the range calculated by the above expression (1), the minimum width of the aluminum fiber nonwoven fabric is 500 mm and the minimum surface areal is 500 g/m$^2$, the following operations such as the cutting work of the automatic nonwoven fabric cutter 14, the subsequent visual inspection and the packaging work become difficult.

By using the above molten metal purifying unit 2, the purity of the molten metal after melting is improved but a fine non-metallic inclusion is produced by the air oxidation in the subsequent step of transferring the molten metal to the crucible 20 in the metallic fiber manufacturing unit 7. This inclusions adhere to and accumulate in the ejection holes to create an imperfect ejection state as described above, thereby deteriorating the quality of the metallic fiber non-woven fabric. To cope with this, as will be disclosed in a third aspect of the present invention, at least one end of the molten metal feed pipe 22 is preferably provided with a filter 23 for removing the non-metallic inclusions floating in the molten metal 29.

FIG. 2 shows an embodiment for explaining the installation position of the filter 23. Since the filter 23 is exposed to the high-temperature molten metal, it is preferably made from a ceramic having excellent heat resistance. The filter 23 having a smaller diameter than the diameter of an ejection hole of the nozzle is selected, with which even when the separation of the non-metallic inclusion which has been captured once in the filter is caused by variations in the pressure of the closed vessel 4 or the vibration of the filter 23 itself, it does not have a bad influence.

Figure 3:
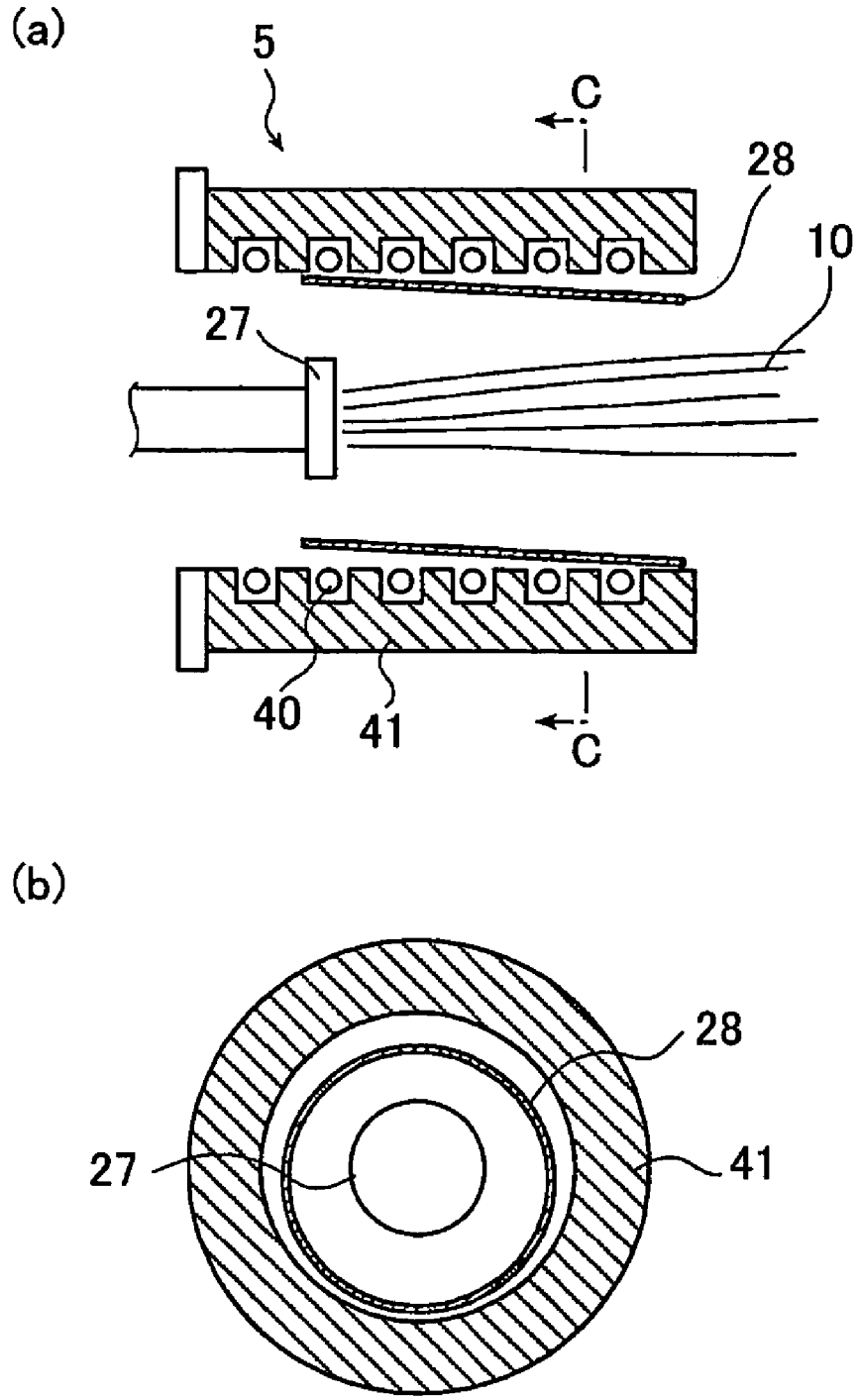
FIG. 3 are schematic diagrams showing a structure of an ejection nozzle heater, in which FIG. 3(*a*) is a longitudinal sectional view and FIG. 3(*b*) is a sectional view in a radial direction.

As shown in FIG. 2 and FIG. 3, the above ejection nozzle 27 is preferably heated with the cylindrical ejection nozzle heater 5. The ejection nozzle heater 5 has a structure that a fire-proof heat insulating material 41 of the ejection nozzle heater is provided with a heat-generating element 40. FIG. 3(*a*) is a longitudinal sectional view of the heater 5. FIG. 3(*b*) is a cross-sectional view taken along the line c—c of FIG. 3(*a*). The installation purpose of the ejection nozzle heater 5 is to fully pre-heat the ejection holes in order to prevent the occlusion of the ejection holes, which is caused by the solidification phenomenon of the molten metal 29 in the extremely small ejection holes when the remaining heat of the ejection nozzle 27 right before ejection is insufficient as described in the above section "Background Art".

As described in a fourth aspect of the present invention, the length from the surface of the ejection nozzle 27 in the ejection direction of the above ejection nozzle heater 5 is preferably 100 to 200 mm. When the length is smaller than 100 mm, the heating of the ejection nozzle 27 in the ejection process becomes insufficient, thereby readily causing the occlusion phenomenon by the solidification of the molten metal in the ejection holes. When the length is larger than 200 mm, the quenching of the semi-solidified aluminum fibers right after ejection is impeded, thereby increasing the fusion phenomenon of the fibers themselves and causing a phenomenon that the formed fibers become extremely fragile. Therefore, the satisfactory aluminum fibers are difficult to manufacture. Further, the expansion of a jet exceeds the inner diameter of the heater of the ejection nozzle 27 (specifically, the inner diameter of a cylindrical iron plate 28 which will be described hereinafter), thereby making ejection impossible.

The inner diameter of the nozzle heater 5 of the present invention is preferably 2.5 to 4 times the outer diameter of the ejection nozzle 27. When the inner diameter is less than 2.5 times the outer diameter of the ejection nozzle 27, the insertion of the cylindrical iron plate 28 for protecting the disconnection of the heat-generating element 40 of the ejection nozzle heater, which will be described hereinafter, becomes difficult. When the inner diameter is larger than 4 times the outer diameter of the ejection nozzle 27, the ejection nozzle heater 5 itself becomes huge, which is not thermally efficient. The expression outer diameter of the ejection nozzle 27 used herein means a diameter of a range where a large number of ejection holes are existent (in the case of a rectangular range, it is the length of a diagonal line) and excludes an ejection nozzle attachment portion external to the range of nozzles.

As described above, when a non-metallic inclusion or the like is caught in the ejection holes and adhered to the inside of the ejection holes, and jets of the molten metal are disturbed and contact the heat-generating element 40 of the above ejection nozzle heater, the heat-generating element 40 is disconnected. To prevent this, the cylindrical steel plate 28 is preferably inserted from the vicinity of the ejection nozzle 27 to cover the above heat-generating element 40 on the ejection side as shown in FIG. 3.

However, means for preventing the disconnection of the heat-generating element 40 of the ejection nozzle heater is not limited to the above cylindrical steel plate 28, and a method of covering grooves in which the heat-generating element 40 of the ejection nozzle heater is embedded with a thin unfixed-form layer made of a refractory may be used.

Figure 4:
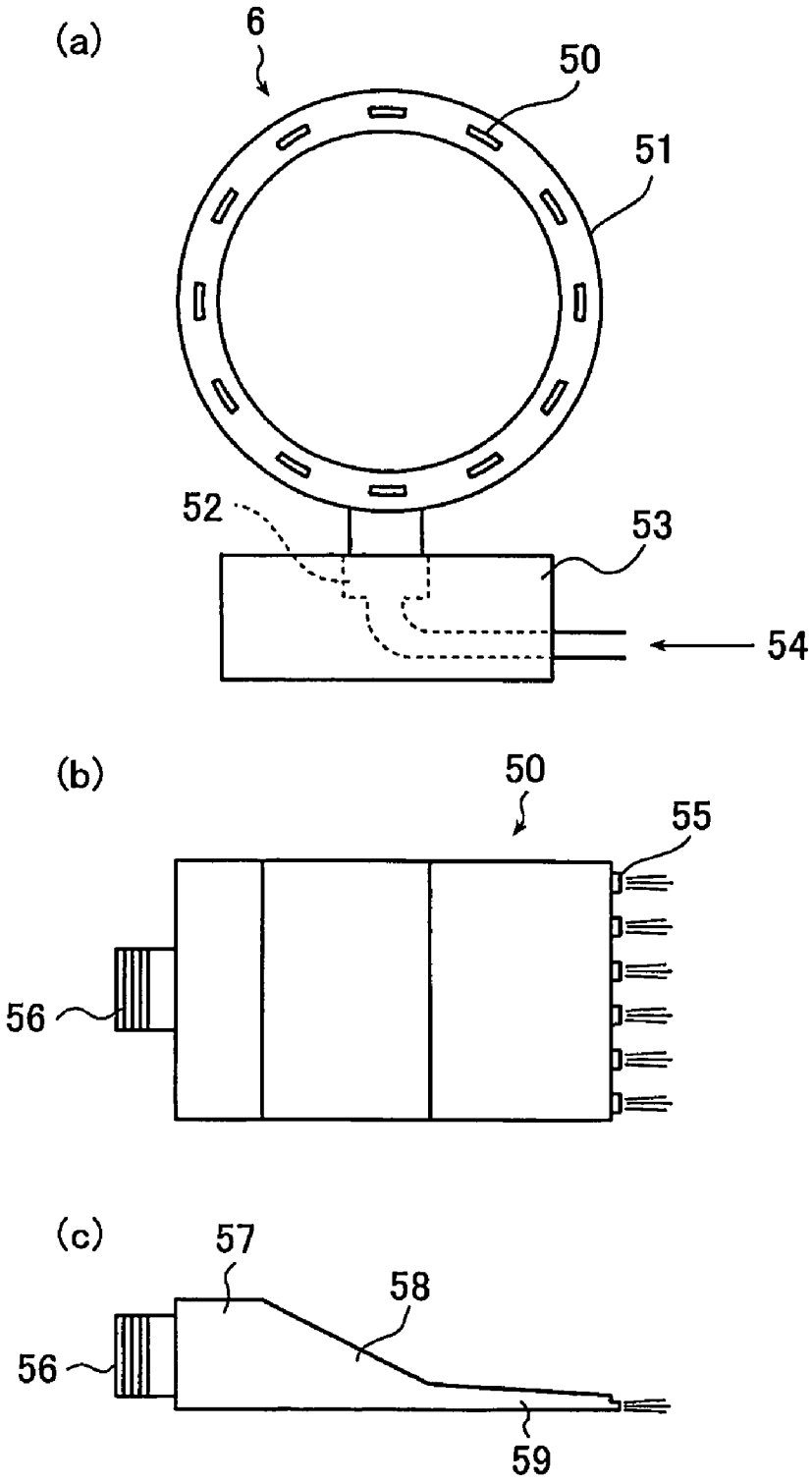
FIG. 4 are diagrams showing a structure of a metallic fiber flying control unit, in which FIG. 4(*a*) is a front view thereof and FIGS. 4(*b*) and 4(*c*) are a plan view and a side view of a flat nozzle 50, respectively.

As shown in FIG. 1, the metallic fiber flying control unit 6 is installed adjacent to the ejection nozzle heater 5. FIG. 4(*a*) is a front view for explaining the metallic fiber flying control unit 6. FIG. 4(*b*) is a front view for explaining a flat nozzle 50 used in this unit. FIG. 4(*c*) is a side view for explaining the flat nozzle 50. The purpose of using this unit is to manufacture the metallic fiber nonwoven fabric 18 having a stable areal density by controlling the flying of metallic fibers produced by solidifying the molten metal to promote the uniform distribution of the metallic fibers 10. The control fluid is compressed air having a pressure of 0.4 MPa to 0.5 MPa. This unit preferably employs the flat nozzles 50 as the nozzles for ejecting the above compressed air.

Here, the flat nozzle 50 is suitably an air nozzle disclosed in JP 1665860 B. FIG. 4(*b*) and FIG. 4(*c*) show the outline thereof. The flat nozzle 50 shown in FIG. 4 is a nozzle for ejecting compressed air from a plurality of ejection ports 55 arranged substantially parallel to one another and having an air storage portion 57 having an expanded diameter for storing air near an air inlet 56, an ejection portion 59 having a reduced diameter on the ejection port 55 side, and a transition portion 58 communicating therebetween. Since this nozzle can create a powerful flow of air with a low noise and low air consumption, it is excellent in metallic fiber flying control. As an embodiment of the present invention, the twelve flat nozzles 50 are attached to a manifold which is processed into a round shape (inner diameter is 350 mm) in the ejection direction of the molten metal as shown in FIG. 4(*a*).

The metallic fibers 10 ejected from the ejection holes of the ejection nozzle 27 shown in FIG. 2 can fly far by using the metallic fiber flying control unit 6 as compared with a case where there is no such unit. As a result of close observation, the extension of the metallic fibers is promoted and the prevention of the formation of a deformed fiber caused by the fusion phenomenon of metallic fibers is also promoted.

The circular ring (circular manifold 51) provided with the flat nozzles 50 of this unit can oscillate in right and left directions at a preset given angle and cycle. The flying metallic fibers 10 are dropped on a belt conveyor 8 of the metallic fiber accumulating/conveying unit 11 which will be described hereinafter. As the metallic fibers 10 drop uniformly by use of this unit at this point, a metallic fiber nonwoven fabric 18 having a stable surface density can bemanufactured. In particular, when the width of the non-woven fabric reaches a level of 1,000 mm, the above oscillating mechanism functions effectively, whereby not only the areal density in the longitudinal direction but also the areal density in the transverse direction become stable, resulting in the stable quality of the nonwoven fabric.

FIG. 1 shows the outline of an embodiment of the metallic fiber accumulating/conveying unit 11 of the present invention. As a metallic fiber accumulation width variable side guide 9 is provided with the belt conveyor 8 at the bottom, shaped like a gutter and made from a transparent resin, it always enables the observation of the metallic fibers 10 being ejected. The metallic fibers 10 dropped and accumulated on the metallic fiber accumulation width variable side guide 9 are moved on the belt conveyor 8 and compressed while they pass through the roll-press unit 12 to press-mold the metallic fiber nonwoven fabric 18.

The width of the above metallic fiber accumulation width variable side guide 9 on the belt conveyor 8 surface is variable and can be easily altered right before ejection according to the width of the metallic fiber nonwoven fabric 18 to be produced. It is important that the height of the metallic fiber accumulation width variable side guide 9 is preferably 100 mm or more, which is not smaller than at least the height of the ejection nozzle 27 in order to prevent the metallic fibers flying after ejection from the ejection holes from scattering to the outside of this unit. The width of the uppermost portion of this unit is preferably larger than the width of the belt conveyor 8 surface, and the resin plates are preferably inclined outward at an angle of 70° to 85° upon the arrangement.

Figure 5:
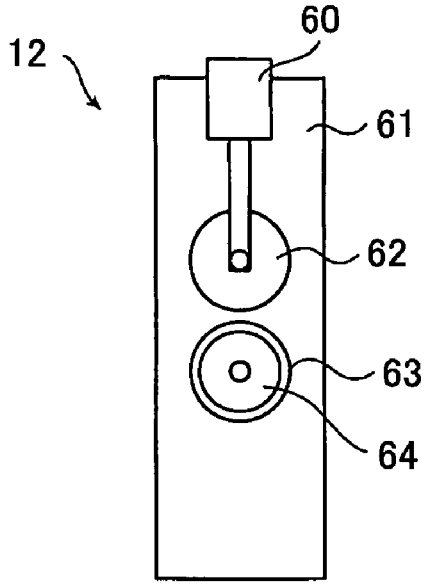
FIG. 5 is a diagram showing an outline of a structure of a roll-press unit.

FIG. 5 shows the outline of the roll-press unit 12 of the present invention. The rolls are preferably made from steel and the surface of a lower roll 64 preferably has a rubber lining 63. The rubber lining 63 is made from urethane rubber to attain the object advantageously.

The purpose of using the rubber lining 63 is to promote the insertion of the metallic fibers 10 into the roll-press unit 12 and to prevent slippage in the roll-pressing process. When the lower roll 64 is lined with urethane rubber, the thickness of the rubber lining is preferably 10 mm to 15 mm. When the upper roll is lined with rubber, the contact bonding of the metallic fiber nonwoven fabric 18 becomes imperfect, thereby deteriorating the product quality.

Figure 6:
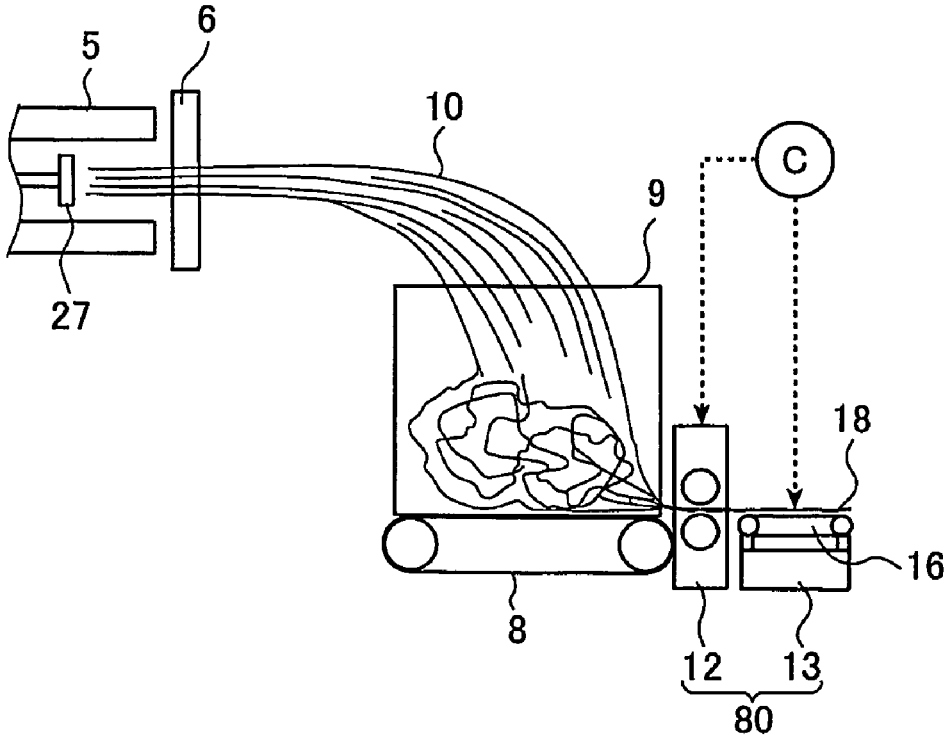
FIG. 6 is a schematic diagram for explaining a nonwoven fabric areal density control mechanism.

FIG. 6 shows the outline of the nonwoven fabric areal density control mechanism 80 composed of the roll-press unit 12 and the nonwoven fabric weighing unit 13. The following expression (2) represents the relationship among an actual weight value $G_1$ measured by the nonwoven fabric weighing unit 13 with a belt conveyor, a total amount M of the metallic fibers ejected from the ejection nozzle 27, and a roll peripheral speed V of the roll-press unit 12. A constant $\alpha$is a constant experimentally obtained in advance based on a areal density D and a width W of each metallic fiber nonwoven fabric 18.

The following expression (3) is used to obtain the above desired or previously specified, calculated target weight, that is, calculated target weight $G_2$ of the metallic fiber nonwoven fabric 18. L in the expression (3) denotes the effective length of the belt conveyor of the nonwoven fabric weighing unit 13 with the belt conveyor. The expression effective length of the belt conveyor means the length of the belt conveyor which is actually involved in weighing to the total length of the above belt conveyor. That is, the total length of portions where the metallic fiber nonwoven fabric 18 is not directly in contact with the top surface of the belt conveyor near both the ends is excluded from the total length of the belt conveyor.

$$G_1=\alpha\times M/V \tag{2}$$

$$G_2=D\times W\times L \tag{3}$$

wherein $G_1$ is the actually measured weight (g), $\alpha$ is a constant (m), M is the total amount of metallic fibers ejected (g/min), V is the roll peripheral speed (m/min), $G_2$ is the calculated target weight of the metallic fiber nonwoven fabric (g), D is the target areal density of the metallic fiber nonwoven fabric (g/m$^2$), W is the width of the metallic fiber nonwoven fabric (m), and L is the effective length (m) of the belt conveyor of the weighing unit with the belt conveyor (m).

In the above expression (2), as the total amount M of the metallic fibers ejected cannot be actually measured, to make the $G_1$ value close to the $G_2$ value, the moving speed V of the metallic fiber nonwoven fabric at the exit of the roll-press unit 12, that is, the roll peripheral speed V of the roll-press unit 12 must be controlled. That is, the roll peripheral speed of the roll (moving speed of the metallic fiber nonwoven fabric) may be calculated from the difference between $G_1$ and $G_2$, and controlled by use of a nonwoven fabric surface density controller C or control means.

The above metallic fiber accumulating/conveying unit 11, roll-press unit 12 and nonwoven fabric weighing unit 13 with the belt conveyor may be controlled in combination and are an example of the nonwoven fabric areal density control mechanism 80 used in the present invention.

A description is subsequently given of the method of manufacturing a laminated aluminum material according to the ninth aspect of the present invention with reference to FIG. 7. The manufacturing method according to the ninth aspect of the present invention is not limited to what is illustrated in FIG. 7. As elements shown in FIG. 7 and denoted by the same reference symbols as in FIGS. 2 and 6 are the same as those already described, their repetitive descriptions are omitted.

Since the constituent elements of the metallic fiber manufacturing apparatus according to the ninth aspect of the present invention, particularly the closed vessel 4, the crucible 20, the molten metal feed pipe 22 and the ejection nozzle 27 are exposed to high temperature, they are made from a material having heat resistance. In particular, the ejection nozzle 27 is made from a material having heat resistance and abrasion resistance, specifically silicon nitride or a material similar to this as the molten metal passes through the ejection holes having a diameter of about 0.1 mm of the ejection nozzle. As for other constituent elements, the closed vessel 4 is generally made from heat resistant bricks and the crucible 20 is made from an alumina silica-based heat resistant material or heat resistant clay. The molten metal feed pipe 22 is made from the same material as the ejection nozzle 27.

In FIG. 7, the manufactured metallic fibers are received by a vessel 19 having the belt conveyor 8 at the bottom. The metallic fibers received by the vessel 19 are carried on the belt conveyor 8 in clusters. When the metallic fibers pass between pressure molding rolls 36 next to the vessel 19, they are pressed to form a metallic fiber nonwoven fabric. By adjusting the speed of the belt conveyor 8, metallic fibers having a desired density can be obtained. To be specific, when the moving speed of the belt conveyor 8 is increased, the density of the metallic fibers becomes low and when the moving speed of the belt conveyor 8 is decreased, the density of the metallic fibers becomes high.

In the method of manufacturing a laminated aluminum material of the present invention, a molten metal containing aluminum as the main component is supplied to the above metallic fiber manufacturing apparatus to accumulate molten aluminum ejected from the ejection holes uniformly on an aluminum expanded metal 32 as aluminum fibers by continuously changing the direction of an air flow from the metallic fiber flying control unit 6. Then, an expanded metal 34 is also supplied on the aluminum fibers to sandwich the aluminum fibers between the expanded metals from above and below and the resulting laminate is contact bonded to obtain a laminated aluminum material having the aluminum fibers sandwiched between the expanded metals.

The expanded metal is obtained by making many cuts into a metal sheet and pulling the sheet in a direction perpendicular to the cuts to be wholly shaped like a net. In the method of the present invention, the expanded metal is made from aluminum or aluminum alloy. The thickness of the expanded metal is not particularly limited but preferably 0.2 mm to 1 mm in general.

In FIG. 7, the expanded metal 32 is supplied from an upstream side of the vessel 19. The molten aluminum metal ejected from the ejection nozzle 27 is accumulated uniformly on the expanded metal 32 passing through the vessel 19 as aluminum fibers by continuously changing an air flow from the metallic fiber flying control unit 6. In this state, the aluminum fibers are piled up at a low density. Therefore, the expanded metal 32 on which the aluminum fibers are accumulated is allowed to pass between the pressure molding rolls 36 to bring the aluminum fibers into close contact with the expanded metal 32. Thus, the aluminum fibers on the expanded metal become dense. Thereafter, the expanded metal 34 is also supplied on the aluminum fibers to sandwich the aluminum fibers between the expanded metals from above and below. In this state, the resulting laminate is allowed to pass between contact bonding rolls 38 to contact bond the laminate. The load at the time of contact bonding may be suitably selected according to the thickness and density of the aluminum fibers to be sandwiched on demand but generally about 300 to 2,000 kg. Needless to say, the method of manufacturing a laminated aluminum material of the present invention is not limited to this. After the aluminum fibers are accumulated on the expanded metal 32, the expanded metal 34 for forming an overlying layer may be supplied and allowed to pass between the pressure molding rolls 36 to manufacture a laminated aluminum material. According to the manufacturing method of the present invention, the laminated aluminum material can be continuously manufactured but may be manufactured as a cut sheet material.

The thus obtained laminated aluminum material has an expanded effective area as the uniformly dispersed aluminum fibers are sandwiched between the expanded metals in the form of the nonwoven fabric. As the aluminum fibers are existent in the form of a nonwoven fabric, the surface of the laminated aluminum material is uneven. When the aluminum material of the present invention is used as an electrode, a heat-sink, a filter or a sound absorbent board, an excellent effect can be expected as the effective area is expanded.

EXAMPLES

Example 1

An example of the method of manufacturing an aluminum fiber nonwoven fabric by the aluminum fiber nonwoven fabric manufacturing method of the present invention using the metallic fiber nonwoven fabric manufacturing apparatus of the present invention shown in FIG. 1 will be described hereinbelow.

First, an aluminum ingot having a purity of 99.7% was inserted into the melting furnace 1 to be completely molten. Further, the upper lid of the melting furnace 1 was removed and the rotary agitation type molten metal purifying unit 2 of a gas blowing system was installed in the furnace. A high-purity argon gas was used as the agitation gas, and the aluminum ingot was treated for about 5 minutes at a gas flow rate of 15 l/min, a blade revolution of 250 rpm and an inversion time of 10 seconds.

About 200 kg of the treated molten aluminum was poured into the crucible 20 in the closed vessel 4 from a transfer port 26 on the rear side (opposite to the ejection side) of the closed vessel 4 through the transfer gutter 3 by inclining the melting furnace 1. The molten metal feed pipe 22 and the ejection nozzle heater 5 were attached to the closed vessel 4 before the above molten metal transfer work. The transfer port 26 of the closed vessel 4 was closed and the atmospheric temperature around the crucible 20 was set and automatically controlled to heat the molten aluminum in the crucible 20 at about 710° C. During this operation, the ejection nozzle heater 5 was closed with the front lid or the like (not shown in FIGS. 1 to 3) and automatically controlled to sufficiently preheat the ejection nozzle 27 so that the inside atmospheric temperature became about 850° C.

Thereafter, the front lid of the above ejection nozzle heater 5 was removed and dry compressed air was supplied into the closed vessel 4 from the pressure unit 25 as a pressurized gas to obtain a sealed state. The pressure of the pressurized gas was adjusted to 0.3 MPa to 0.4 MPa during ejection. The pressure of the pressurized gas was adjusted manually while the state of ejection and the accumulation of the aluminum fibers in the metallic fiber accumulation width variable side guide 9 were observed.

In this example, a nozzle having 100 holes was used as the ejection nozzle 27 when the areal density of the nonwoven fabric shown in Table 1 was 550 g/m$^2$ and a nozzle having 200 holes was used when the areal density was 1,650 g/m$^2$. The inner diameter of the ejection holes was about 0.1 mm in either case.

Right before ejection, the metallic fiber flying control unit 6 was in operation. The compressed air pressure of the unit was set to 0.4 MPa and the flow rate was set to 330 Nm$^3$/hr. The oscillation angle was set to 10° and the number of oscillation cycles was set to 70 per minute.

As described in detail in the section "Embodiment Mode of the Invention", the areal density (g/m$^2$) of the aluminum fiber nonwoven fabric was automatically controlled by controlling the roll peripheral speed V of the roll-press unit 12 to minimize the difference obtained by the comparison between the calculated target weight value $G_2$ based on the target surface density calculated by the nonwoven fabric surface density control mechanism and the actual weight value $G_1$ measured by the nonwoven fabric weighing unit 13 with the belt conveyor when the aluminum fiber nonwoven fabric passes through the nonwoven fabric weighing unit 13 with a belt conveyor.

The length of the aluminum nonwoven fabric was automatically detected by a nonwoven fabric length detection sensor 15 and the aluminum nonwoven fabric was automatically cut by the automatic nonwoven fabric cutter 14. After cutting, the existence of surface density nonuniformity in the aluminum fiber nonwoven fabric was visually inspected on a nonwoven fabric visual inspection table 16.

The above inspection table 16 is composed of a milky white coloured acrylic resin board and the areal density nonuniformity of the nonwoven fabric can be visually detected easily by installing a plurality of fluorescent lamps right below the resin board. The aluminum fiber nonwoven fabrics which were accepted by the visual inspection were piled up in a corrugated board case to be stored. To prevent adhesion between nonwoven fabrics at this point, inserting paper for metal (acid-free paper) of almost the same size as the nonwoven fabric was inserted between the nonwoven fabrics.

Table 1 shows the weights and the visual inspection results of 10 nonwoven fabrics which were experimentally manufactured on the same production line and sampled at random (excluding one nonwoven fabric manufactured right after the start of ejection and one nonwoven fabric manufactured right before the end of ejection) and had set the areal density and the size for the nonwoven fabrics. As obvious from this table, it was confirmed that the actual weights were within ±10% of the calculated target weights. The results of visual inspection were satisfactory. That is, the large areal density nonuniformity and the phenomenon that the drip (aluminum thin piece solidified like slaver) was formed on the surface of the ejection nozzle 27 just before the ejection hole was occluded with the non-metallic inclusion or the like and mixed in the nonwoven fabric together with an unstable jet as described in the above section "Embodiment Mode of the Invention" were not seen at all.

TABLE 1

| Nonwoven fabric areal density ($g/m^2$) | | 550 | 1,650 520 × | Result of visual |
|---|---|---|---|---|
| Nonwoven fabric size (mm) | | 630 × 2,050 | 1,040 | inspection |
| Calculated target weight (g) | | 710 | 892 | No abnormality |
| Actual weight (g) | Nonwoven fabric 1 | 721 | 895 | No abnormality |
| | Nonwoven fabric 2 | 735 | 930 | No abnormality |
| | Nonwoven fabric 3 | 705 | 935 | No abnormality |
| | Nonwoven fabric 4 | 730 | 920 | No abnormality |
| | Nonwoven fabric 5 | 715 | 915 | No abnormality |
| | Nonwoven fabric 6 | 740 | 905 | No abnormality |
| | Nonwoven fabric 7 | 724 | 920 | No abnormality |
| | Nonwoven fabric 8 | 735 | 922 | No abnormality |
| | Nonwoven fabric 9 | 690 | 895 | No abnormality |
| | Nonwoven fabric 10 | 685 | 880 | No abnormality |

Example 2

A laminated aluminum material was manufactured using the apparatus shown in FIG. 7. First, aluminum having a purity of 99.7% was heated and molten to prepare a molten metal, which was injected into the crucible 20. The injection of the molten metal into the crucible 20 was carried out by removing the upper lid 42 put on the closed vessel 4 and inserting a steel funnel into a hopper 43. To prevent the molten metal from being cooled and solidified at this point, the heater 21 was used to maintain the inside temperature of the closed vessel 4 at the same level as the temperature of 700° C. of the molten metal.

Nitrogen was supplied from the pressure unit 25 at 0.3 MPa to press the surface of the molten metal 29 in the crucible 20 in order that the molten metal went up inside the molten metal feed pipe 22 by a siphon effect achieved thereby, so that the molten metal was ejected from the ejection ports having a diameter of about 0.1 mm provided in the ejection nozzle 27 to be formed into fibers. The thus formed aluminum fibers were uniformly dispersed on the expanded metal 32 passing through the vessel 19 by continuously changing an air flow from the metallic fiber flying control unit 6. By allowing the aluminum fibers to pass between the pressure molding rolls 36 in this state, the aluminum fibers were brought into close contact with the expanded metal 32 and the expanded metal 34 was also supplied on the aluminum fibers to sandwich the aluminum fibers between the expanded metals from above and below. Then, this aluminum laminate was allowed to pass between the contact bonding rolls 38 in this state to contact bond the laminate, thereby obtaining the laminated aluminum material having the aluminum fibers sandwiched between the expanded metals. The load applied by the contact bonding rolls 38 was about 1,000 kg. The used expanded metals had the mesh structure with a size of a center distance in a short mesh direction of 3 mm, a center distance in a long mesh direction of 4 mm, a width of 1 m, and a thickness of 1 mm.

The thickness of the aluminum fiber nonwoven fabric layer of the obtained laminated aluminum material was 1.6 mm.

To confirm that the aluminum fibers were uniformly dispersed in the laminated aluminum material, a 1 m-square laminated aluminum material was manufactured, and ten 10 cm-square samples were cut out from the material at random to measure their weights. As a result, it was confirmed that differences in weight among the samples were within ±10%.

INDUSTRIAL APPLICABILITY

The metallic fiber nonwoven fabric manufacturing apparatus according to the present invention can prevent the solidification of a molten metal in the ejection holes of the ejection nozzle and the occlusion of the ejection holes with the non-metallic-inclusion, whereby it is possible to stably manufacture the metallic fiber nonwoven fabric. It is also possible to manufacture the satisfactory metallic fiber nonwoven fabric without the deformed fiber or solidified metal piece to be mixed which seems to be caused by the fusion of half-solidified metallic fibers right after ejection. Further, the aluminum metallic fiber nonwoven fabric having stable quality and characteristics without the above inclusions and nonuniformity in surface density can be manufactured by using the method of manufacturing an aluminum fiber nonwoven fabric according to the present invention.

The method of manufacturing a laminated aluminum material according to the present invention makes it possible to manufacture a laminated aluminum material having such a structure that the aluminum fibers are uniformly dispersed in the form of the nonwoven fabric between two expanded metals in a satisfactory manner. The laminated aluminum material manufactured by the method of the present invention has an expanded surface area because the aluminum fibers are uniformly dispersed and existent in the form of the nonwoven fabric. The surface of the material is made uneven with the expanded metals.

What is claimed is:

1. A metallic fiber nonwoven fabric manufacturing apparatus comprising:

a melting furnace comprising a molten metal purifying unit;

a metallic fiber manufacturing unit which comprises a closed vessel having a crucible fpr storing a molten metal and a heater therefor; a molten metal feed pipe having one and an other opening, the one opening positioned near a bottom portion of the crucible, the other opening situated outside the closed vessel and an ejection nozzle having a plurality of ejection holes for ejecting the molten metal to the outside of the closed vessel at an end of the other opening; and a pressure unit for supplying a pressurized gas into the closed vessel;

an ejection nozzle heater provided on an outer wall of the closed vessel to surround the ejection nozzle;

a metallic fiber flying control unit for discharging compressed air and forming an air flow in an ejection direction of the molten metal from the nozzle as a control fluid for promoting a uniform distribution of metallic fibers by controlling flying of the metallic fibers produced by solidifying the molten metal ejected from the ejection nozzle, the metallic fiber flying control unit being positioned on a downstream side of the nozzle and adapted for continuously changing a direction of the air flow;

a metallic fiber accumulating/conveying unit for temporarily accumulating the produced metallic fibers and conveying the fibers;

a metallic fiber accumulating/conveying/roll-pressing unit for press-molding a metallic fiber nonwoven fabric by roll-pressing the obtained accumulated product;

a nonwoven fabric areal density control mechanism for controlling a surface density of the metallic fiber nonwoven fabric to a predetermined range; and an automatic nonwoven fabric cutter.

2. The metallic nonwoven fabric manufacturing apparatus according to claim 1, wherein the ejection holes formed in the ejection nozzle have an inner diameter of 0.05 mm to 0.25 mm, an interval between the adjacent ejection holes is 5 mm or more, and the number of ejection holes satisfies the following expression:

$$0.4<nD^2<2.5$$

wherein n is the number of holes of the ejection nozzle and D is the inner diameter of the ejection holes (mm).

3. The metallic fiber nonwoven fabric manufacturing apparatus according to claim 1, wherein at least one end of the molten metal feed pipe is provided with a filter for removing a non-metallic inclusion suspended in the molten metal.

4. The metallic fiber nonwoven fabric manufacturing apparatus according to claim 1, wherein the ejection nozzle heater has a length from a surface of the ejection nozzle of 100 to 200 mm in an ejection direction and an inner diameter 2.5 to 4 times an outer diameter of the ejection nozzle.

5. The metallic fiber nonwoven fabric manufacturing apparatus according to claim 1, wherein the metallic fiber flying control unit has compressed air ejection nozzles which are flat nozzles for delivering the compressed air in a flat form, the flat nozzles being adapted to oscillate in right and left directions at a preset given angle and cycle.

6. The metallic nonwoven fabric manufacturing apparatus according to claim 1, wherein the roll-press unit has at least a pair of an upper roller and a lower roll for conveying and pressing the metallic fiber and a surface of the lower roll is lined with rubber.

7. The metallic fiber nonwoven fabric manufacturing apparatus according to claim 1, wherein the nonwoven fabric areal density control mechanism compares a target weight of a desired metallic fiber nonwoven fabric and an actual weight measured by a nonwoven fabric weighing unit with a belt conveyor and controls a moving speed of the metallic fiber nonwoven fabric at exit of the roll-press unit to minimize a difference therebetween.

8. A method of manufacturing an aluminum metallic fiber nonwoven fabric, comprising manufacturing an aluminum fiber nonwoven fabric by using the metallic fiber nonwoven fabric manufacturing apparatus according to claim 1.

9. A method of manufacturing a laminated aluminum material having aluminum fibers sandwiched between aluminum expanded metals, comprising:

supplying molten aluminum to a metallic fiber manufacturing unit which comprises:

a closed vessel having a crucible for storing a molten metal;

a molten metal feed pipe which is open at both ends and has one and an other opening, the one opening positioned near a bottom portion of the crucible and the other opening situated outside the closed vessel through an opening formed in a side wall of the closed vessel and provided with an ejection nozzle having ejection holes;

a pressure unit for supplying a pressurized gas into the closed vessel; and a metallic fiber flying control unit arranged on a downstream side of the nozzle, for forming an air flow in an ejection direction of the molten metal from the nozzle and continuously changing a direction of the air flow;

accumulating the molten aluminum ejected from the ejection ports uniformly on the aluminum expanded metal as the aluminum fiber with the metallic fiber flying control unit for continuously changing the direction of the air flow from the ejection nozzle;

supplying the expanded metal on the aluminum fibers; and contact bonding the aluminum fibers to the expanded metals from above and below.

10. The metallic fiber nonwoven fabric manufacturing apparatus according to claim 2, wherein at least one end of the molten metal feed pipe is provided with a filter for removing a non-metallic inclusion suspended in the molten metal.

11. The metallic fiber nonwoven fabric manufacturing apparatus according to claim 2, wherein the ejection nozzle heater has a length from a surface of the ejection nozzle of 100 to 200 mm in an ejection direction and an inner diameter 2.5 to 4 times an outer diameter of the ejection nozzle.

12. The metallic fiber nonwoven fabric manufacturing apparatus according to claim 2, wherein the metallic fiber flying control unit has compressed air ejection nozzles which are flat nozzles for delivering the compressed air in a flat form, the flat nozzles being adapted to oscillate in right and left directions at a preset given angle and cycle.

13. The metallic nonwoven fabric manufacturing apparatus according to claim 2, wherein the roll-press unit has at least a pair of an upper roller and a lower roll for conveying and pressing the metallic fiber and a surface of the lower roll is lined with rubber.

14. The metallic fiber nonwoven fabric manufacturing apparatus according to claim 2, wherein the nonwoven fabric areal density control mechanism compares a target weight of a desired metallic fiber nonwoven fabric and an actual weight measured by a nonwoven fabric weighing unit with a belt conveyor and controls a moving speed of the metallic fiber nonwoven fabric at exit of the roll-press unit to minimize a difference therebetween.

15. The metallic fiber nonwoven fabric manufacturing apparatus according to claim 3, wherein the ejection nozzle heater has a length from a surface of the ejection nozzle of 100 to 200 mm in an ejection direction and an inner diameter 2.5 to 4 times an outer diameter of the ejection nozzle.

16. The metallic fiber nonwoven fabric manufacturing apparatus according to claim 3, wherein the metallic fiber flying control unit has compressed air ejection nozzles which are flat nozzles for delivering the compressed air in a flat form, the flat nozzles being adapted to oscillate in right and left directions at a preset given angle and cycle.

17. The metallic nonwoven fabric manufacturing apparatus according to claim 3, wherein the roll-press unit has at least a pair of an upper roller and a lower roll for conveying and pressing the metallic fiber and a surface of the lower roll is lined with rubber.

18. The metallic fiber nonwoven fabric manufacturing apparatus according to claim 3, wherein the nonwoven fabric areal density control mechanism compares a target weight of a desired metallic fiber nonwoven fabric and an actual weight measured by a nonwoven fabric weighing unit with a belt conveyor and controls a moving speed of the metallic fiber nonwoven fabric at exit of the roll-press unit to minimize a difference therebetween.

19. The metallic fiber nonwoven fabric manufacturing apparatus according to claim 4, wherein the metallic fiber flying control unit has compressed air ejection nozzles which are flat nozzles for delivering the compressed air in a flat form, the flat nozzles being adapted to oscillate in right and left directions at a preset given angle and cycle.

20. The metallic nonwoven fabric manufacturing apparatus according to claim 4, wherein the roll-press unit has at least a pair of an upper roller and a lower roll for conveying and pressing the metallic fiber and a surface of the lower roll is lined with rubber.

21. The metallic fiber nonwoven fabric manufacturing apparatus according to claim 4, wherein the nonwoven fabric areal density control mechanism compares a target weight of a desired metallic fiber nonwoven fabric and an actual weight measured by a nonwoven fabric weighing unit with a belt conveyor and controls a moving speed of the metallic fiber nonwoven fabric at exit of the roll-press unit to minimize a difference therebetween.

22. The metallic nonwoven fabric manufacturing apparatus according to claim 5, wherein the roll-press unit has at least a pair of an upper roller and a lower roll for conveying and pressing the metallic fiber and a surface of the lower roll is lined with rubber.

23. The metallic fiber nonwoven fabric manufacturing apparatus according to claim 5, wherein the nonwoven fabric areal density control mechanism compares a target weight of a desired metallic fiber nonwoven fabric and an actual weight measured by a nonwoven fabric weighing unit with a belt conveyor and controls a moving speed of the metallic fiber nonwoven fabric at exit of the roll-press unit to minimize a difference therebetween.

24. The metallic fiber nonwoven fabric manufacturing apparatus according to claim 6, wherein the nonwoven fabric areal density control mechanism compares a target weight of a desired metallic fiber nonwoven fabric and an actual weight measured by a nonwoven fabric weighing unit with a belt conveyor and controls a moving speed of the metallic fiber nonwoven fabric at exit of the roll-press unit to minimize a difference therebetween.

* * * * *